US007789067B2

(12) United States Patent
Benassi et al.

(10) Patent No.: US 7,789,067 B2
(45) Date of Patent: Sep. 7, 2010

(54) CONTROL METHOD IN THE CASE OF A FAULT IN AN INTERNAL COMBUSTION ENGINE FITTED WITH A SERVO-ASSISTED BUTTERFLY VALVE

(75) Inventors: Daniele Benassi, Bologna (IT); Stefano Sgatti, Imola (IT); Loris Lambertini, Crespellano (IT)

(73) Assignee: Magneti Marelli Powertrain S.p.A. (IT)

( * ) Notice: Subject to any disclaimer, the term of this patent is extended or adjusted under 35 U.S.C. 154(b) by 287 days.

(21) Appl. No.: 12/125,286

(22) Filed: May 22, 2008

(65) Prior Publication Data

US 2009/0000594 A1 Jan. 1, 2009

(30) Foreign Application Priority Data

May 25, 2007 (EP) ..... 07425324

(51) Int. Cl.
*F02D 29/00* (2006.01)
*F02D 11/00* (2006.01)

(52) U.S. Cl. ..... 123/399; 123/361; 123/198 F

(58) Field of Classification Search ..... 123/399, 123/361, 198 F, 198 DB, 350, 479, 480; 701/101, 701/103

See application file for complete search history.

(56) References Cited

U.S. PATENT DOCUMENTS 5,601,063 A 2/1997 Ohashi et al. ..... 123/396
5,629,852 A * 5/1997 Yokoyama et al. ..... 701/101
6,230,094 B1 5/2001 Ohashi et al. ..... 701/107
6,267,099 B1 7/2001 Yamada et al. ..... 123/396
2003/0094157 A1 5/2003 Tachibana et al. ..... 123/406.13

FOREIGN PATENT DOCUMENTS

EP 1 178 204 2/2002
GB 2 226 658 7/1990

OTHER PUBLICATIONS

European Search Report dated May 20, 2008 in corresponding European Application No. 07425324.

* cited by examiner

*Primary Examiner*—Hieu T Vo
(74) *Attorney, Agent, or Firm*—Ostrolenk Faber LLP

(57) ABSTRACT

Control method in the case of a fault in an internal combustion engine; the control method provides for the phases of: cyclically checking the correct functioning of a connection between an electronic control unit and an electric drive of an electric actuator coupled to a butterfly valve to control the position of the same butterfly valve, switching off the electric drive in the case of interruption in the connection between the electronic control unit and the electric drive so that the butterfly valve sets itself in a predefined limp-home position, and piloting the engine in the case of interruption in the connection between the electronic control unit and the electric drive to keep the number of revs constant and equal to a predefined emergency value.

8 Claims, 2 Drawing Sheets

CONTROL METHOD IN THE CASE OF A FAULT IN AN INTERNAL COMBUSTION ENGINE FITTED WITH A SERVO-ASSISTED BUTTERFLY VALVE

TECHNICAL FIELD

The present invention concerns a control method in the case of a fault in an internal combustion engine fitted with a servo-assisted butterfly valve.

The present invention finds useful application in the control of an internal combustion engine of a motor vehicle (or rather, a two-wheeled vehicle), to which the following description will make explicit reference, but without any loss in generality.

BACKGROUND ART

Electronics, both passive (sensors to detect control quantities) and active (actuators for directly operating mechanical components), are increasingly present in modern motor vehicles. For example, virtually all motor vehicles have electronic injection, namely fuel injectors that are operated by electric actuators piloted by an electronic control unit, and are fitted with a lambda sensor, or rather a probe able to detect the composition of the exhaust gas. Recently, the application of DBW (Drive By Wire) systems has been proposed, in which the accelerator is no longer mechanically connected to the engine throttle control, but is only connected to a position sensor that detects the position of the accelerator and, in consequence, pilots an actuator that mechanically operated the butterfly valve.

DBW (Drive By Wire) systems are provided with an electronic control unit, which receives readings from a position sensor that detects the position of the accelerator and operates an electric actuator that controls an electric drive that pilots the butterfly valve's actuator. A particularly dangerous fault that would normally impose immediate switching off of the engine (or rather the halting of the motor vehicle) is the disconnection of the cable that connects the electronic control unit to the electric drive that pilots the butterfly valve's actuator, as in this situation the electronic control unit is no longer able to control the position of the butterfly valve.

DISCLOSURE OF INVENTION

The object of the present invention is to provide a control method in the case of a fault in an internal combustion engine fitted with a servo-assisted butterfly valve, this control method being of easy and economic embodiment and allowing the vehicle to continue to be driven with reduced performance in order to autonomously reach a service centre.

In accordance with the present invention, a control method is provided in the case of a fault in an internal combustion engine fitted with a servo-assisted butterfly valve as claimed in the attached claims.

BRIEF DESCRIPTION OF THE DRAWINGS

The present invention shall now be described with reference to the attached drawings, which illustrate a non-limitative example of embodiment, in which.

PREFERRED EMBODIMENTS OF THE INVENTION

Figure 1:
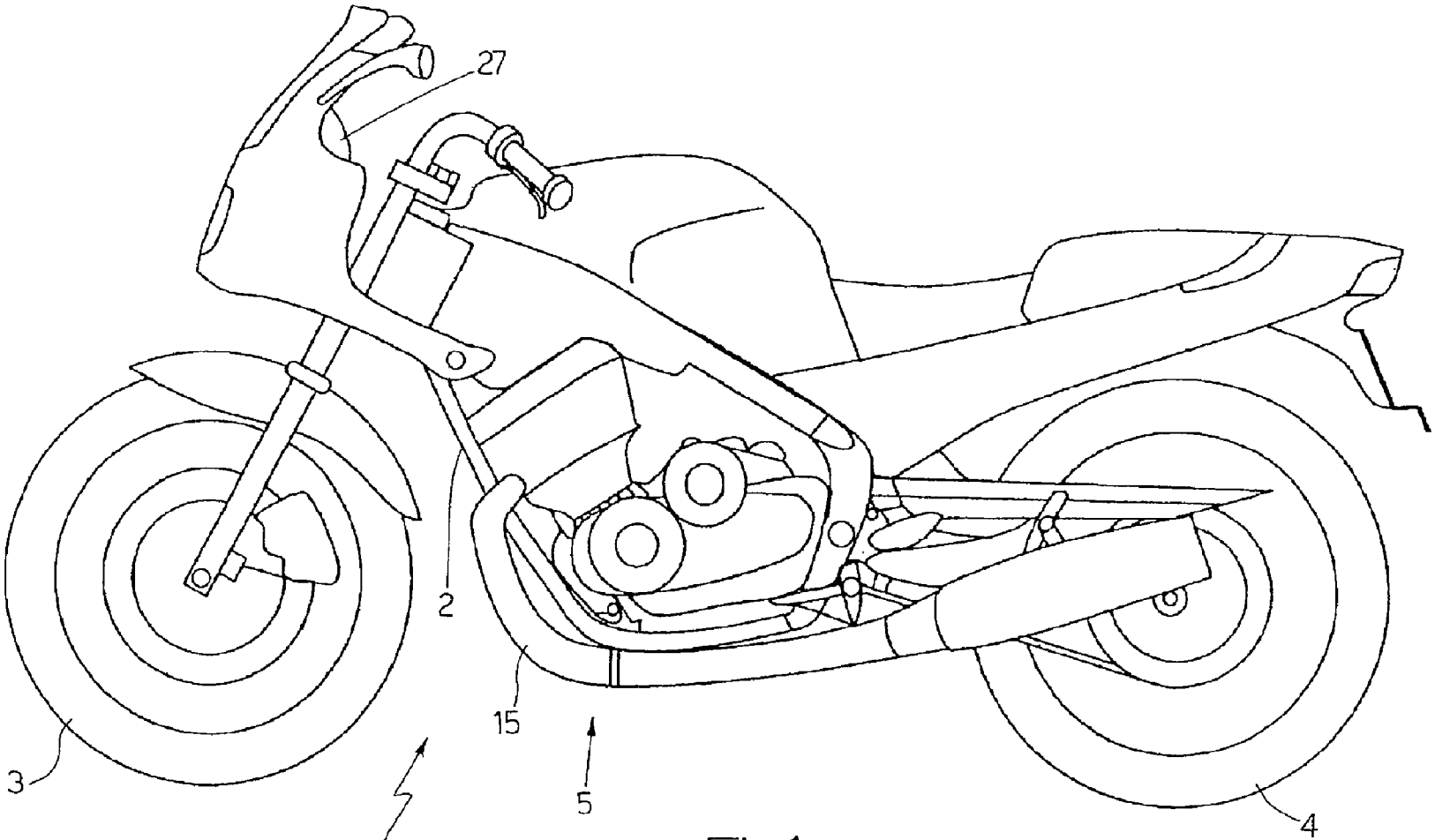
FIG. 1 is a schematic view of a motorcycle that implements the present invention's control method in the case of a fault.

In FIG. 1, reference numeral 1 indicates a motorcycle as a whole, comprising a chassis 2 that supports a front wheel 3 via a front suspension, a rear wheel 4 via a rear suspension and a petrol-fuelled internal combustion engine 5.

Figure 2:
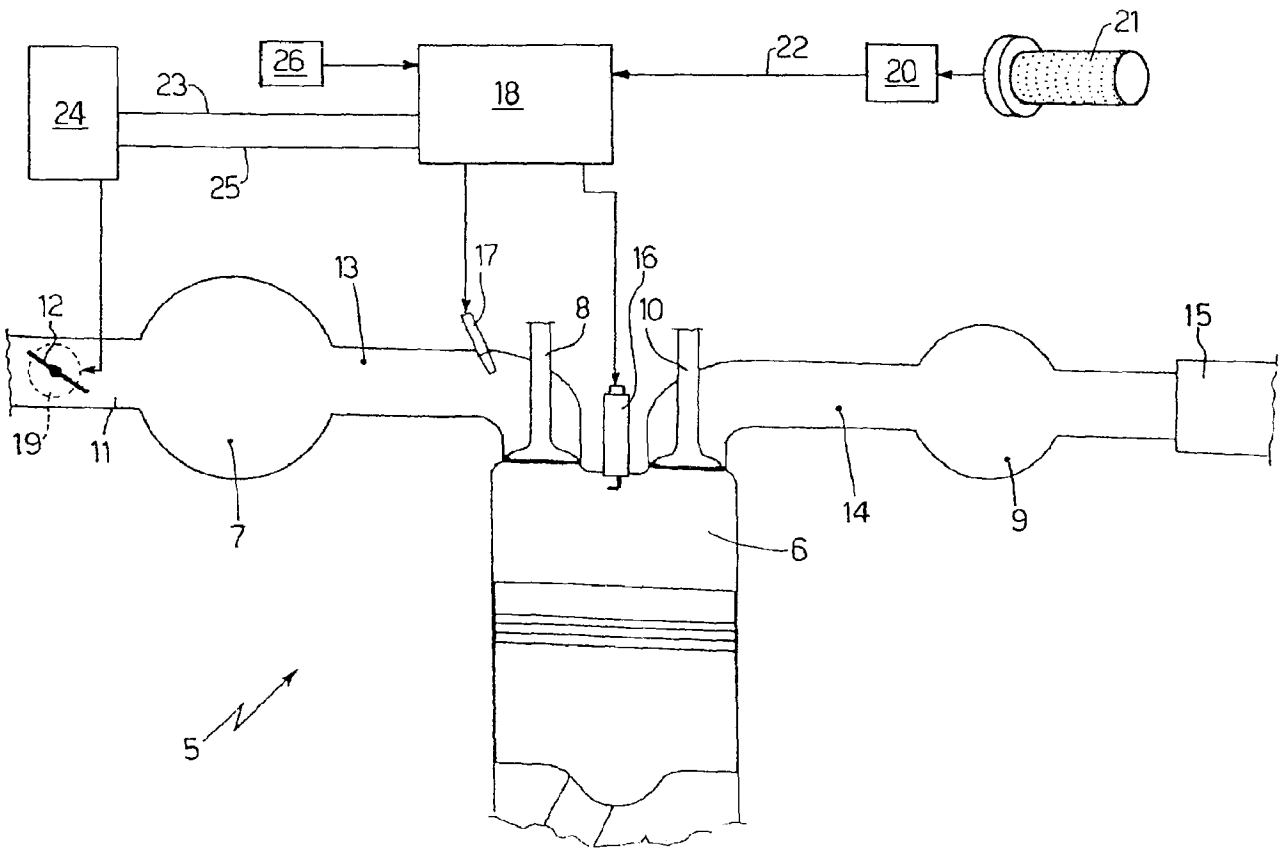
FIG. 2 is a schematic view of an internal combustion engine of the motorcycle in FIG. 1.

As shown in FIG. 2, the internal combustion engine 5 is fitted with a number of cylinders 6 (only one of which is shown in FIG. 2), each of which is connected to an intake manifold 7 via two intake valves 8 (only one of which is shown in FIG. 2) and an exhaust manifold 9 via two exhaust valves 10 (only one of which is shown in FIG. 2).

The intake manifold 7 receives fresh air (or rather air coming from the outside environment) through a feed duct 11 regulated by a butterfly valve 12 and is connected to the cylinders 6 via respective intake ports 13 (only one of which is shown in FIG. 2), each of which is regulated by the corresponding intake valves 8. Similarly, the exhaust manifold 9 is connected to the cylinders 6 via respective exhaust ports 14 (only one of which is shown in FIG. 2), each of which is regulated by the corresponding exhaust valves 10; an exhaust pipe 15, terminating in a silencer, runs from the exhaust manifold 9 to discharge the gases produced by combustion into the atmosphere.

Each cylinder 6 includes a spark plug 16, which is positioned at the top the cylinder 6 and is cyclically piloted to ignite the mixture at the end of the compression phase (that is in correspondence to TDC—Top Dead Centre). According to the embodiment shown in FIG. 2, the fuel (or rather the petrol) is injected inside each intake port 13 via a respective injector 17 positioned close to the corresponding intake valves 8. According to another embodiment, not shown, the injectors 17 are positioned in a manner to inject fuel directly into each cylinder 6.

An electronic control unit 18 superintends the running of the internal combustion engine 5, piloting the injectors 17 and the spark plugs 16. In addition, the electronic control unit 18 implements a DBW (Drive By Wire) system; in consequence, the butterfly valve 12 is servo-controlled and is operated by an electric actuator 19 that is controlled by the electronic control unit 18 according to the signals received from a position sensor 20, which detects the position of an accelerator 21 of the motorcycle 1 in real time. For safety reasons, the position sensor 20 has at least two mutually redundant potentiometers, so that the reading provided by a potentiometer can always be confirmed by the reading provided by the other potentiometer.

According to the embodiment shown in FIG. 2, the electronic control unit 18 is connected by an electric cable 22 to the position sensor 20 and is connected by a CAN/BUS type electric cable 23 to an electric drive 24 that pilots the electric actuator 19; in other words, the electronic control unit 18 sends the desired position for the butterfly valve 12 to the electric drive 24 via the AN/BUS type electric cable 23 and the electric drive 24 supplies the necessary electric current (via a feedback control) to the electric actuator 19 to set the butterfly valve 12 in the desired position. According to the embodiment shown in FIG. 2, the electronic control unit 18 is connected to the electric drive 24 via an additional electric cable 25 that the switching on and off of the electric drive 24. The electronic control unit 18 is also connected to a speed sensor 26, which determines the speed (or rather the number of revolutions) of the internal combustion engine 5.

The electronic control unit 18 includes a plurality of diagnostic algorithms that are cyclically executed to determine the onset of possible faults in components of the motorcycle 1. Some faults do not involve the main components of the motorcycle 1 and are therefore just signalled to the rider of the motorcycle 1 by the turning on of a specially provided warning light on the instrument panel 27. Instead, other faults involve the main components of the motorcycle 1 and render driving at full performance dangerous for the rider and/or mechanics, whilst driving the motorcycle 1 with reduced performance is possible (or rather, fairly safe) in order to reach a service centre with the motorcycle 1.

In particular, the electronic control unit 18 and possibly the electric drive 24 as well, cyclically check the correct functioning of the connection between the electronic control unit 18 and the electric drive 24. If an interruption in the connection between the electronic control unit 18 and the electric drive 24 occurs, the electronic control unit 18 is no longer able to communicate the desired position for the butterfly valve 12 to the electric drive 24; in this situation, the electric drive 24 is switched off so that the butterfly valve 12 sets itself in a predefined limp-home position and the internal combustion engine 5 is piloted to keep the number of revs constant and equal to a predefined and calibratable emergency value (for example, between 2000 and 3000 rpm).

With respect to normal running, to keep the number of revs constant and equal to the predefined emergency value, the electronic control unit 18 normally cuts the injection of fuel (i.e. it acts on the injectors 17) and/or stops the ignition spark for the mixture inside the cylinder 6 (i.e. it acts on the spark plugs 16).

During the design phase of the internal combustion engine 5 the quantity of limp-home air that is made to pass through the butterfly valve 12 in the limp-home position is determined in advance and this quantity of limp-home air is stored in the electronic control unit 18; therefore, in the case of interruption of the connection between the electronic control unit 18 and the electric drive 24, the quantity of fuel to inject via the injectors 17 is determined in function of the effective number of revs (or rather, the difference between the effective number of revs and the desired number of revs, equal to the predefined emergency value) and in function of the quantity of limp-home air. In this way, it is possible to avoid feeding the cylinders 6 with an excessively rich mixture (i.e. with too much fuel in relation to the air present) or an excessively lean (i.e. with too little fuel in relation to the air present) mixture.

Normally, in the case of interruption of the connection between the electronic control unit 18 and the electric drive 24 (i.e. in the case of interruption of the CAN/BUS type electric cable 23), the electronic control unit 18 sends a switch-off command to the electric drive 24 using the electric cable 25 that controls the switching on and off of the electric drive 24. Obviously, in the case of interruption of the connection between the electronic control unit 18 and the electric drive 24 (i.e. in the case of interruption of the CAN/BUS type electric cable 23), the electric drive 24 could autonomously switch itself off without requiring and/or awaiting a special command from the electronic control unit 18; this possibility renders the system more robust, as it is unaffected by a possible break in the electric cable 25 as well. Alternatively, in order to remain on, the electric drive 24 could require a non-zero electrical voltage on the electric cable 25 and therefore, in the case of the electric cable 25 breaking, the electric drive 24 would autonomously and automatically switch itself off.

The above-described control method for the internal combustion engine 5 in the case of interruption of the connection between the electronic control unit 18 and the electric drive 24 offers numerous advantages, as it is simple and economic to produce, provides a high level of safety for the rider of the motorcycle 1 and allows the rider of the motorcycle 1 to ride the motorcycle 1 (obviously at reduced speed) to a service centre without needing to call a tow truck.

The invention claimed is:

1. Control method in the case of a fault on an internal combustion engine (5) comprising:

at least one cylinder (6), at least one injector (17) to inject fuel, at least one butterfly valve (12) to regulate the flow of air sucked into the cylinder (6), a position sensor (20) to determine the position of an accelerator control, an electric actuator (19) coupled to the butterfly valve (12) to control the position of the butterfly valve (12), an electric drive (24) to pilot the electric actuator (19), and an electronic control unit (18), which is connected to the position sensor (20) for reading the position of the accelerator control and is connected to the electric drive (24) to send a desired position value for the butterfly valve (12) to the same electric drive (24);

the control method is characterized in comprising the phases of:

cyclically checking the correct functioning of the connection between the electronic control unit (18) and the electric drive (24);

switching off the electric drive (24), in the case of interruption in the connection between the electronic control unit (18) and the electric drive (24), so that the butterfly valve (12) sets itself in a predefined limp-home position; and piloting the engine (5), in the case of interruption in the connection between the electronic control unit (18) and the electric drive (24), to keep the number of revs constant and equal to a predefined emergency value.

2. Control method according to claim 1 and including the additional phases of:

determining in advance a quantity of limp-home air that is made to pass through the butterfly valve (12) in the limp-home position; and determining, in the case of interruption in the connection between the electronic control unit (18) and the electric drive (24), a quantity of fuel to inject in function of the number of revs and in function of the quantity of limp-home air.

3. Control method according to claim 1, wherein the electronic control unit (18) is connected to the electric drive (24) via a first electric cable (23) of the CAN/BUS type.

4. Control method according to claim 3, wherein the electronic control unit (18) is also connected to the electric drive (24) via a second electric cable (25) that controls the switching on and off of the electric drive (24).

5. Control method according to claim 1, wherein, in the case of interruption in the connection between the electronic control unit (18) and the electric drive (24), the electronic control unit (18) sends a switch-off command to the electric drive (24).

6. Control method according to claim 1, wherein, in the case of interruption in the connection between the electronic control unit (18) and the electric drive (24), the electric drive (24) autonomously switches itself off.

7. Control method according to claim 1, wherein, in the case of interruption in the connection between the electronic control unit (18) and the electric drive (24), the number of revs is kept constant and equal to the predefined emergency value by cutting the injection of fuel.

8. Control method according to claim 1, wherein, in the case of interruption in the connection between the electronic control unit (18) and the electric drive (24), the number of revs is kept constant and equal to the predefined emergency value by interrupting the ignition spark for the mixture inside the cylinder (6).

* * * * *